United States Patent [19]

Babel

[11] Patent Number: 4,712,479

[45] Date of Patent: Dec. 15, 1987

[54] MINE WITH ALARM AND TRIGGERING SENSORS

[75] Inventor: Wolfgang Babel, Rothenbach, Fed. Rep. of Germany

[73] Assignee: Diehl GmbH & Co., Nuremberg, Fed. Rep. of Germany

[21] Appl. No.: 921,951

[22] Filed: Oct. 21, 1986

[30] Foreign Application Priority Data

Oct. 31, 1986 [DE] Fed. Rep. of Germany ..... 3538785

[51] Int. Cl.[4] ..... F42C 11/00; F42C 15/14

[52] U.S. Cl. ..... 102/427; 102/215

[58] Field of Search ..... 102/427, 419, 420, 215, 102/221, 424

[56] References Cited

U.S. PATENT DOCUMENTS 2,411,787 11/1946 Hammond, Jr. ..... 102/427

3,509,791 5/1970 Pechamat et al. ..... 102/427

4,296,686 10/1981 Marer ..... 102/427

FOREIGN PATENT DOCUMENTS 3045837 1/1984 Fed. Rep. of Germany .

OTHER PUBLICATIONS

Wehrtechnik, vol. 9/1981, p. 78 and vol. 2/1985, p. 96, vol. 7/1985, pp. 85 and 86.

*Primary Examiner*—Charles T. Jordan

*Attorney, Agent, or Firm*—Scully, Scott, Murphy & Presser

[57] ABSTRACT

A mine including a seismic or vibration-responsive alarm sensor for a triggering sensor adapted to initiate a detonating signal. The mine is equipped with a reversible electrically-actuatable securing arrangement for the emission of the triggering or detonating signal, which can be reset through the intermediary of the alarm sensor from its armed position into the secured condition.

8 Claims, 1 Drawing Figure

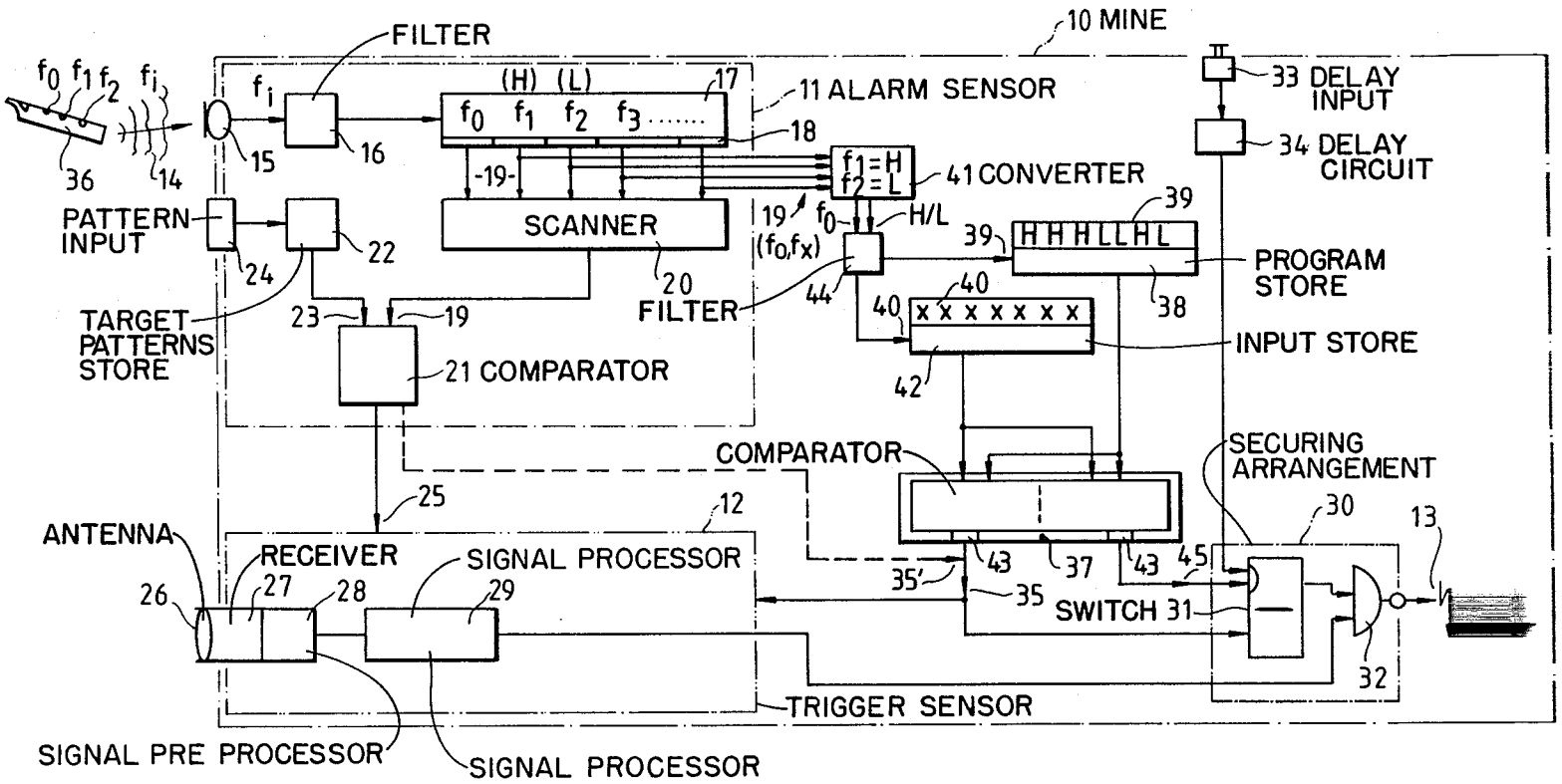
10 MINE
11 ALARM SENSOR
33 DELAY INPUT
34 DELAY CIRCUIT
PROGRAM STORE
INPUT STORE
SECURING ARRANGEMENT
30
13
32
39
38
41 CONVERTER
H H H L L H L
x x x x x x x
40
42
43
37
45
31
SWITCH
35
35'
COMPARATOR
TRIGGER SENSOR
f1=H
f2=L
H/L
f0
44
19
(f0,fx)
FILTER
18
17
20
SCANNER
(H) (L)
f0 f1 f2 f3
-19-
21 COMPARATOR
12
SIGNAL PROCESSOR
29
SIGNAL PROCESSOR
25
RECEIVER
28
27
16
22
23
24
15
14
36
PATTERN INPUT
TARGET PATTERNS STORE
ANTENNA
26
SIGNAL PRE PROCESSOR

MINE WITH ALARM AND TRIGGERING SENSORS

BACKGROUND OF THE INVENTION

1. Field of the Invention

The present invention relates to a mine including a seismic or vibration-responsive alarm sensor for a triggering sensor adapted to initiate a detonating signal.

2. Discussion of the Prior Art

A mine of the construction type which is under consideration herein, is known from the disclosure of German Patent No. 30 45 837, in which an alarm or waking sensor responds to vibrations from a particular target object located within the range of airborne sound, so as to liberate the triggering sensor for the attacking of the target object.

However, especially with respect to the inventive mine is there consideration given that the latter is positioned at a certain distance from the locale of action and directed thereagainst so that, by means of the triggering sensor, there is determined the point in time at which the warhead or combat charge is to be detonated, inasmuch as a typical target object which alone is to be attacked is acquired at an expedient spatial position relative to the location of the mine; such as is considered in the periodical *WEHRTECHNIK*, Vol. 9/1981 (middle of the left-hand column on page 78), and explained in further detail in *WEHRTECHNIK* 1985, Vol. 2 (page 96) and Vol. 7 (pages 85 and 86).

Hereby, the present invention is predicated on the concept that such types of modern mines can be rendered deployable for numerous applications by means of comparatively minor additional demands on apparatus, so as to be able to better justify the comparatively high demands placed on the employment of modern sensor technologies.

SUMMARY OF THE INVENTION

The foregoing object is inventively obtained with a mine pursuant to the constructional type under consideration, in that the mine is equipped with a reversible electrically-actuatable securing arrangement for the emission of the triggering or detonating signal, which can be reset through the intermediary of the alarm sensor from its armed position into the secured condition.

In accordance with the foregoing, the mine can be deployed a number of times; in effect, at different subsequent locations when it has, heretofore, not yet been triggered; whereby there is provided, for the indelicate or rough handling during the displacement to another location, a securing arrangement which can be electrically reset into the secured condition, for the serving of which by a military mine or combat engineer there need not be constructed any special setting mechanisms on the mine which must be manipulated, inasmuch as the alarm sensor which is already available can also be employed for the operation or servicing of the securing arrangement.

Expediently, the switching-over operation of the securing arrangement is effected through the alarm sensor within the same frequency spectrum, in which the alarm already operates for the detection of the approach of a target which is probably to be attacked; such that a filter bank which is already provided in the alarm sensor; for example, for the analysis of a frequency pattern, can also be utilized for the detection of the information for the switching over of the securing arrangement, inasmuch as, for this purpose, there is simply definitely activated an airborne-sound signal transmitter at a distance from the mine.

Preferably, the sound transmitter serves not only for the input of a certain pattern of pulse lengths or modulations, or for a pattern of tone sequences for comparison with a preset switching information for effecting the resetting of the securing arrangement into its secure condition, whereby the mine is thereafter no longer armed and can be handled without any danger; but after the (renewed) repositioning of the mine, also serves for the task of providing the switching reference information itself to which this mine (in effect, every mine of a certain mine field) should again respond later on for arming thereof, when the mine has not been brought to detonation by a target object which is to be attacked.

The sound transmitter can also serve, in the same manner, for the input of an unsecuring or arming information, so as to be able to arm the mine from a safe distance (in effect, every mine of a mine field located in the sound field) after installation.

BRIEF DESCRIPTION OF THE DRAWING

Additional alternatives and further embodiments, as well as further features and advantages of the invention can now be readily ascertained from the following detailed description of an exemplary embodiment of the novel mine; taken in conjunction with the accompanying single figure of drawing illustrating a circuit block diagram of the equipping of a mine with an alarm or waking sensor for its triggering sensor, and with a reversible securing arrangement, which in the illustrated example can be set, through the contactless coupling in of vibrating or seismic energy, into a condition of being in the armed position as well as being resettable into the secured or safe condition.

DETAILED DESCRIPTION

The illustrated mine incorporates an alarm sensor 11 which is responsive to vibration energy, which upon the approach of a target object (not shown) which is to be attacked, activates a detonation-triggering sensor 12 which has heretofore been switched-off for the purpose of providing a saving in energy, which upon triggers a detonating signal 13 for the warhead (not shown) upon detection of a target for the attacking of the target object.

The alarm sensor 11 can be a seismic sensor adapted for the pickup of ground vibrations caused by the approaching target object. However, universally employable is a waking or alarm sensor 11 which responds to airborne sound 14 inasmuch as, on the one hand, the coupling of the alarm sensor 11 to the transmitting medium becomes uncritical or less delicate, while, on the other hand, there can also be picked up and evaluated the broad higher-frequencied spectrum fi, which is not transmitted as sound conducted through solids above the background, but due to physical reasons can be more simply analyzed with band filters, and also allows for more positive conclusions over the type of the approaching vehicle to allow for the discrimination of a real target.

For instance, such an alarm sensor 11 which is responsive to airborne-sound vibrations is equipped with a microphone 15 for the conversion of the vibration energy into electrical energy, and with a filtering amplifier 16 for the band-limited preamplification of the picked-up airborne-sound frequency spectrum fi. This is analyzed in a correlated filter bank 17 (which, in principle, relates to an arrangement of narrow band filters correlated with different frequencies of threshold stages 18 connected to the output thereof) with regard to the presence of typical frequencies f0, f1, f2, determinative of the target object which is to be acquired. Frequencies f which are contained within the spectrum fi with an adequate intensity, will switch through the associated threshold stage 18 for the emission of output signals 19. The pattern of the signals (in essence, their presence during the interrogation of the filter bank 17 by a scanner 20) is compared in a comparator 21 (which can relate to a complex pattern comparator, or simply to a logic gating circuit) with an applicable pattern which is held in readiness in a target discriminating storage 22. This comparative pattern 23 can be permanently predetermined during the manufacture of the mine 10, when it is to be employed only against certain target objects; or the mine combat engineer can, by means of an input arrangement 24, select during the installation of a mine field among different predetermined comparative patterns 23, and can even by himself provide a predetermined comparative pattern 23, in order to prepare the mine 10 selectively with respect to the specific case of application for a certain class of target objects which are characterized by their sound radiation and which are alone to be attacked.

When the comparator 21 determines a coincidence of patterns, it then delivers an actuating signal 25 to the actual triggering sensor 12, which is designed more complex for target acquisition and, correspondingly, evidences a greater energy requirement; in effect, prior to the approach of a target object which is probably to be attacked, will remain switched-off in order to save energy. The triggering sensor 12 preferably operates passively in the millimeter-wave or infrared range, such that its position and readiness for operation cannot be detected by the approaching target object through irradiated bearing or position-finding energy. For this purpose, arranged behind an antenna aperture 26 is a receiver 27 with a signal preprocessor 28 which is designed for the applicable range of the electromagnetic energy. A preferably correlatively operating detection signal processor 29 serves for the filtering out of predetermined target criteria from the received clutter and thereby for the improvement of the usable signal/interference signal, such that only under an optimally geometric relationship between the target object which is actually to be attacked and the operative direction of the mine, will the warhead of the latter be detonated through the detonating signal 13.

The detonating signal 13 can, in any event, only be actuated when the securing arrangement has been armed. For this purpose, the latter is equipped with a bistable electronic selector switch 31 which prepares an AND gate 32 only for activation from the triggering sensor 12, when the securing arrangement has been placed into its armed position. For example, this can be carried out manually by the mine combat engineer during the installation of the mine field through an input element 33, preferably through a delay circuit 34, such that the securing arrangement 30 of the mine 10 will actually only be set into its armed position when a safe time interval has passed after the handling by the mine combat engineer in the mine field.

When the mine 10 is no longer required at the initially provided locale, but is to be inserted at a different location, the securing arrangement 30 is to be reset into its secure or safe condition, so that the mine combat engineer need not hereby handle an armed explosive body. For this purpose, a resetting signal 35 is delivered to the selector switch 31; in effect, there is neutralized the readiness of the AND gate 32 for the emission of a detonating signal 13. Preferably, the resetting signal 35 serves concurrently for the switching-off of the triggering sensor 12, which produces an increased degree of safety against the possible undesired emitting of a detonating signal, and at the same time provides for a termination of the present load imparted to the energy supply which is built into the mine 10.

However, an unauthorized person should not be able to again disarm the initially located mine 10, and to possibly employ it for his own purposes; and it is also intended that the mine combat engineer should need not to directly handle the still armed mine 10 in order to reset the latter into its secured or safe condition.

Consequently, provision is made that the alarm or waking sensor 11, which can be actuated without contact by means of vibration energy, be also employed for the return of the mine securing arrangement 30 into the secured condition. For this purpose, there can be generated a definite vibration frequency in proximity to the mine 10, which leads to the triggering of a resetting signal 35. Expediently, utilized for this purpose is the filter bank 17 which is already present in the alarm sensor 11, thus, for the return into the secured position at least one frequency is introduced in the frequency spectrum fi which is in any event to be evaluated. Such an airborne sound frequency presetting can be carried out from a relatively large distance and thereby from a safe position, concurrently and commonly for all correspondingly equipped mines 10 of a mine field in an uncomplicated manner by means of a sound transmitter 36, the latter of which is known as a signal flute.

In order to ensure that only an authorized person can, by means of such a sound transmitter 36, reset the mine 10 into its secured position, there is expediently provided a multi-tone flute by means of which (in the type of generally playing a block flute) there can be produced a freely-selectable sequence of discrete frequencies fx within the evaluatable frequency spectrum fi. When this frequency sequence is extremely untypical for a target object which is to be attacked, then the comparator 21 which is already present, together with storage, can be designed to emit the resetting signal 35' in this case, inasmuch as the manually introduced frequency sequence fx coincides with the partern in the program storage 22 preset for the secured position; as is illustrated by phantom-lines in the drawing.

In the interest of obtaining a greater degree of safety against unauthorized re-securing, as well as the most possible undisrupted, clear obtention of the resetting signal 35, it is however, more expedient, as indicated in the drawing, that independently of the function of the waking or alarm sensor 11, there be provided a separate comparator 37 for the remote-controlled switching of the securing arrangement. This delivers the resetting signal 35, when the switching information 39 which is held in readiness in a control or program storage 38 stands in a certain relationship with an actual input information 40; for example coincides therewith. The actual input information 40 through intermediary of the sound generator 36 thus generates, in that (in the illustrated embodiment) the filter bank 17 is interrogated by means of a converter 41 as to the occurrence of certain frequencies fx, the input information 40, which is transmitted binary-coded into an input storage 42.

In the simplest instance, there is contemplated that, by means of the sound generator 36 there are generated only two different frequencies f1, f2, which have the logic conditions H and L associated therewith in the converter 42; so that the comparator 37 emits the resetting signal 35 when the input information 40 corresponds to the pregiven binary pattern of the switching information 39.

These binary patterns are expediently selected as socalled Barker codes, such as are currently employed in the communications technology, inasmuch as the comparator 37 in the shape of a correlator (pulse compressing filter) will then deliver an extremely defined correlation result in the instance of a coincidence, which can be emitted through a threshold stage 43 as an extremely interference-free resetting signal 35. Entered in the drawing as the switching information 39 is the simple 7-segment Barker code; preferred in practice are lengthier (combined) Barker codes, whereby an unauthorized person cannot find the switching code through probing, upon recognition of the concretely measurable frequencies fx.

It is particularly advantageous when, for the applicable mine 10, the securing code, in effect, the switching information is not fixedly preset; but rather when the mine combat engineer, after the installation of a mine field, can preset a common switching information 39 for all mines 10 which come into consideration. Only then can the authorized person, who knows the switching information 39, and from this knowledge, without any direct handling of the individual mine 10 can introduce the information 40 from a safe distance through airborne sound 14 which, for example, again leads to the resecuring of the entire mine field which is again to be relocated.

For the input of the switching information 39 there preferably serves the sound transmitter 36; which is triggered with a certain frequency sequence fx, which is introduced encoded into the program or data storage 38.

For a simplification in handling, provision can be made that not due the sound tones fx, but at the generation of an additional tone fo; for example, at the input of a pulse pattern by means of this tone fo, there can be switched over a separating filter 44 through the evaluation in the converter 41, which causes that the fx information 39/40 thereafter appearing in the output signals 19 of the filter bank 17, are alternatively transmitted as a program or as a switching command into one or the other storage 38/42; possibly, after a previous erasing of the storage contents.

In the same manner as the resetting signal 35, without any contact can there be transmitted a setting signal 45 to the selector switch 31 of the securing arrangement 30; in effect, through the airborne sound 14, so as not through actuation of the input element 33 of a single mine 30, but from a safe distance, and possibly again concurrently for all mines 10 of a mine field, to set the mines 10 into their armed position. Also for this purpose can there be previously predetermined a switching information 39; or a separate storage is already provided during manufacture thereof with the arming information which is typical for a certain species of mines; which after the installation of the mines 20, is to be generated renewed as input information 40. For a simplification of the illustrative representation in the drawing, the comparator 37 is shown with two channels for the switching over of the securing arrangement 30, while a common program storage 38 is to be loaded with a switching information 39 for either the setting or for the resetting of the securing arrangement 30 (namely, in dependence upon its momentary condition). In the same manner can the storage 38 also be built with two channels, in order to have all informations 39 available in parallel; or the comparator 37 can be single-channeled and equipped with an alternating output, in order to alternatively emit the switching signals 35/45.

The comparator 37 can also be constructed as a simple binary-pattern comparator, as mentioned hereinabove in connection with the comparator 21. However, more expedient for reasons of freedom from interference is the above-described pulse-compressing processing; insofar as this can be realized within the framework of the processing equipment for the correlative target detection-signal processing unit 29; in effect, will require practically no additional circuitry.

What is claimed is:

1. A mine comprising a vibration-responsive waking or alarm sensor; a triggering sensor for emitting a detonating signal responsive to said alarm sensor; a reversible electrically-actuatable securing arrangement for the emission of said detonating signal, said securing arrangement being resettable by said alarm sensor from an armed position into a secured condition.

2. Mine as claimed in claim 1, wherein said securing arrangement is settable by the alarm sensor from its secured condition into the armed position.

3. Mine as claimed in claim 1, wherein an airborne sound transmitter effects the switching over of the securing arrangement.

4. Mine as claimed in claim 3, wherein the sound transmitter generates different tones in a freely-selectable sequence.

5. Mine as claimed in claim 3, wherein the sound transmitter emits tones within a frequency spectrum evaluatable by said alarm sensor.

6. Mine as claimed in claim 1, wherein the securing arrangement comprises a bistable selector switch connected to the output of a comparator for a pregiven switching information and input information determined by the alarm sensor.

7. Mine as claimed in claim 6, wherein the comparator comprises a correlator for binary-pulse patterns provided by discrete frequencies.

8. Mine as claimed in claim 1, wherein storages sequentially receive switching informations and input informations for comparison with said switching informations through said alarm sensor.

* * * * *